US011408576B2

(12) United States Patent
Zhu et al.

(10) Patent No.: US 11,408,576 B2
(45) Date of Patent: Aug. 9, 2022

(54) HIGH AND LOW BEAM INTEGRATED VEHICLE LAMP LIGHTING DEVICE, VEHICLE LAMP, AND VEHICLE

(71) Applicant: HASCO VISION TECHNOLOGY CO., LTD., Shanghai (CN)

(72) Inventors: He Zhu, Shanghai (CN); Zhiping Qiu, Shanghai (CN); Cong Li, Shanghai (CN); Hui Li, Shanghai (CN); Wenhui Sang, Shanghai (CN)

(73) Assignee: HASCO VISION TECHNOLOGY CO., LTD, Shanghai (CN)

( * ) Notice: Subject to any disclaimer, the term of this patent is extended or adjusted under 35 U.S.C. 154(b) by 0 days.

(21) Appl. No.: 17/429,864

(22) PCT Filed: Feb. 25, 2020

(86) PCT No.: PCT/CN2020/076663

§ 371 (c)(1),
(2) Date: Aug. 10, 2021

(87) PCT Pub. No.: WO2020/173444

PCT Pub. Date: Sep. 3, 2020

(65) Prior Publication Data

US 2022/0136671 A1 May 5, 2022

(30) Foreign Application Priority Data

Feb. 25, 2019 (CN) ..... 201910138161.X
Sep. 10, 2019 (CN) ..... 201921500240.2

(51) Int. Cl.
*F21S 41/25* (2018.01)
*F21S 41/24* (2018.01)
*F21W 102/13* (2018.01)

(52) U.S. Cl.
CPC ..... *F21S 41/25* (2018.01); *F21S 41/24* (2018.01); *F21W 2102/13* (2018.01)

(58) Field of Classification Search
CPC ..... F21S 41/25; F21S 41/24; F21W 2102/13
(Continued)

(56) References Cited

U.S. PATENT DOCUMENTS

2012/0262935 A1* 10/2012 Yamamoto ..... F21S 41/148 362/516
2013/0114280 A1 5/2013 Oh
(Continued)

FOREIGN PATENT DOCUMENTS

CN 103443534 A 12/2013
CN 205991417 U 3/2017
(Continued)

OTHER PUBLICATIONS

English translation of written opinion in the international search report of the corresponding PCT application WO2020/173071A1.

*Primary Examiner* — Laura K Tso
(74) *Attorney, Agent, or Firm* — Volpe Koenig

(57) ABSTRACT

A high and low beam integrated vehicle lamp lighting device, a vehicle lamp, and a vehicle. The lighting device comprises a first light source, a first light-condensing element, a second light source, a second light-condensing element, a light distribution element, and a lens; the first light-condensing element is arranged to be capable of condensing light emitted by the corresponding first light source and making the light projected through the lens by means of the light distribution element to form a low beam shape, and the second light-condensing element is arranged to be capable of condensing light emitted by the corresponding second light source and making the light projected through the lens by means of the light distribution element to form a high beam shape, wherein the light exit direction of at least
(Continued)

one of the first light-condensing element and the second light-condensing element intersects with a light shape projection direction.

18 Claims, 13 Drawing Sheets

(58) Field of Classification Search
USPC ..... 362/511, 538, 539
See application file for complete search history.

(56) References Cited

U.S. PATENT DOCUMENTS

| | | | | |
|---|---|---|---|---|
| 2014/0016343 | A1 | 1/2014 | Brendle | |
| 2017/0292671 | A1* | 10/2017 | Gousset-Rousseau | ..... F21S 41/285 |
| 2018/0058651 | A1 | 3/2018 | Gromfeld | |
| 2018/0087745 | A1 | 3/2018 | Gromfeld | |

FOREIGN PATENT DOCUMENTS

| | | | |
|---|---|---|---|
| CN | 107366870 | A | 11/2017 |
| CN | 108302457 | A | 7/2018 |
| CN | 108302473 | A | 7/2018 |
| CN | 207674345 | U | 7/2018 |
| CN | 106122870 | B | 11/2018 |
| CN | 108758547 | A | 11/2018 |
| CN | 109630976 | A | 4/2019 |
| CN | 209399286 | A | 9/2019 |
| CN | 210219613 | U | 3/2020 |
| JP | 2017130361 | A | 7/2017 |
| WO | 12034936 | A1 | 3/2012 |
| WO | 2020 173 071 | A1 | 9/2020 |

* cited by examiner

HIGH AND LOW BEAM INTEGRATED VEHICLE LAMP LIGHTING DEVICE, VEHICLE LAMP, AND VEHICLE

CROSS-REFERENCE TO RELATED APPLICATIONS

This application is a 35 USC § 371 national stage of international application No. PCT/CN2020/076663, which is entitled "HIGH AND LOW BEAM INTEGRATED VEHICLE LAMP LIGHTING DEVICE, VEHICLE LAMP, AND VEHICLE," was filed Feb. 25, 2020, and claims the benefit of Chinese patent application No. 201910138161.X, filed on Feb. 25, 2019, and Chinese patent application No. 201921500240.2, filed on Sep. 10, 2019, all of which are incorporated herein by reference as if fully set forth.

FIELD

The disclosure relates to a vehicle lamp lighting device, in particular to a high and low beam integrated vehicle lamp lighting device. In addition, the disclosure further relates to a vehicle lamp and a vehicle.

BACKGROUND

High and low beams are commonly used lighting tools for vehicles during travelling. When driving in open or dark places such as highways or suburbs, people need to use high beams, but when there is a vehicle on the opposite side that needs to pass each other, people need to switch to low beams. Moreover, driving on urban roads, low beams are generally used to prevent the high beams from affecting the vision of the driver of the oncoming vehicle and the pedestrians on the road due to the large angle of the high beams, causing a safety hazard.

At present, automobile front combination lamps mostly use a high and low beam integrated light emitting module. A low beam light condenser and a high beam light condenser are superimposed up and down to collect and collimate light emitted from a light source to form the corresponding light shape. Structures of the low beam light condenser and the high beam light condenser both extend in a front-rear direction, so the arrangement in the lamp has certain limitations.

In view of this, it is necessary to design a novel high and low beam integrated vehicle lamp lighting device that can overcome the above technical problems and effectively solve or alleviate the above technical problems.

SUMMARY

The basic technical problem to be solved by the disclosure is to provide a high and low beam integrated vehicle lamp lighting device, which can not only enable the size in a front-rear direction to be reduced, but also has good heat dissipation performance and is convenient for miniaturization.

Further, the technical problem to be solved by the disclosure is to provide a vehicle lamp, which has a smaller size in the front-rear direction and has good heat dissipation performance.

In addition, the technical problem to be solved by the disclosure is to provide a vehicle, which has a vehicle lamp having a smaller size and is convenient to design.

In order to solve the above technical problems, the disclosure provides a high and low beam integrated vehicle lamp lighting device, including at least one first light source, at least one first light-condensing element, at least one second light source, at least one second light-condensing element, a light distribution element and a lens, wherein the first light-condensing element is arranged to be capable of condensing light emitted by the corresponding first light source and making the light projected through the lens by means of the light distribution element to form a low beam shape, and the second light-condensing element is arranged to be capable of condensing light emitted by the corresponding second light source and making the light projected through the lens by means of the light distribution element to form a high beam shape; wherein the light exit direction of at least one of the first light-condensing element and the second light-condensing element intersects with a light shape projection direction.

Optionally, the light distribution element includes an oblique reflecting surface and a front-rear extending reflecting surface, the oblique reflecting surface and the front-rear extending reflecting surface are connected to form a bent structure, and a front end of the front-rear extending reflecting surface is provided with a cut-off boundary; the first light-condensing element is arranged to make exit light thereof intercepted by the cut-off boundary and projected through the lens to form the low beam shape with a low beam cut-off line, exit light of the second light-condensing element propagates along an up-down direction, and the second light-condensing element is arranged to make the exit light thereof reflected by the oblique reflecting surface to form the high beam shape; or the exit light of the first light-condensing element propagates along the up-down direction, the first light-condensing element is arranged to make the exit light thereof reflected by the oblique reflecting surface, intercepted by the cut-off boundary and finally projected through the lens to form the low beam shape with a low beam cut-off line, and the second light-condensing element is arranged to make the exit light thereof projected through the lens to form the high beam shape.

Specifically, the light distribution element is a bent plate, the oblique reflecting surface and the front-rear extending reflecting surface are formed on an outer surface or an inner surface of the light distribution element, and the cut-off boundary is formed on an upper edge of the front end of the light distribution element.

More specifically, a plate thickness of the light distribution element is not less than 0.1 mm and not greater than 2 mm.

Optionally, the plate thickness of the light distribution element is not less than 0.1 mm and not greater than 0.5 mm.

Optionally, a front end of the front-rear extending reflecting surface is of a concave arc shape.

Specifically, the first light-condensing element and the second light-condensing element are both transparent total internal reflection lenses.

Optionally, a light exit surface of the first light-condensing element and/or a light exit surface of the second light-condensing element is a grid surface.

Optionally, the light distribution element includes a first light passing portion and a second light passing portion, the first light passing portion is connected to the second light passing portion through a total reflection surface to form an L-shaped structure, and the second light passing portion is provided with a cut-off portion for forming a low beam cut-off line; the first light-condensing element is disposed on a light entrance surface of the first light passing portion and is integrally formed with the first light passing portion; and the second light-condensing element is located behind and below the light distribution element and is arranged to make the exit light thereof projected through the lens to form the high beam shape; or the second light-condensing element is disposed on the light entrance surface of the first light passing portion and is integrally formed with the first light passing portion; and the first light-condensing element is located behind and above the light distribution element and is arranged to make the exit light thereof intercepted by the cut-off portion and projected through the lens to form the low beam shape with the low beam cut-off line.

Further, the light distribution element further includes a III region forming portion, the III region forming portion is located on a first surface or a second surface of the second light passing portion, and the first surface and the second surface are disposed opposite to each other.

Optionally, the III region forming portion is disposed on the first surface, and the III region forming portion is a groove.

Further, a bottom surface of the groove is provided with a grid pattern or a strip pattern.

Optionally, the III region forming portion is disposed on the first surface, the III region forming portion is a protrusion, and a surface of the protrusion opposite to the first surface is disposed at an included angle with the first surface.

Further, the surface of the protrusion opposite to the first surface is provided with a grid pattern or a strip pattern.

Optionally, the III region forming portion is disposed on the second surface, the III region forming portion is a protrusion, and a cross section of the protrusion is triangular.

Optionally, a light exit surface of the second light passing portion is a concave curved surface.

Optionally, the light distribution element includes an L-shaped low beam distribution element and an L-shaped high beam distribution element, the low beam distribution element corresponds to each of the first light-condensing elements, and the high beam distribution element corresponds to each of the second light-condensing elements.

Further, the low beam distribution element includes a low beam up-down light channel, a low beam total reflection surface and a low beam front-rear light channel, the low beam up-down light channel is connected to the low beam front-rear light channel through the low beam total reflection surface to form an L-shaped structure, and a light entrance surface of the low beam up-down light channel is integrally provided with the first light-condensing elements; and the high beam distribution element includes a high beam up-down light channel, a high beam total reflection surface and a high beam front-rear light channel, the high beam up-down light channel is connected to the high beam front-rear light channel through the high beam total reflection surface to form an L-shaped structure, and a light entrance surface of the high beam up-down light channel is integrally provided with the second light-condensing elements.

Optionally, the low beam total reflection surface is a flat surface, a concave surface or a convex surface, and the high beam total reflection surface is a flat surface, a concave surface or a convex surface.

Optionally, a lower side line of a light exit surface of the low beam distribution element is in contact with an upper side line of a light exit surface of the high beam distribution element, and a wedge-shaped gap gradually increasing from front to rear is formed between the low beam distribution element and the high beam distribution element.

Optionally, the low beam total reflection surface and/or a lower side surface of the low beam front-rear light channel is provided with a high-reflecting film, the light exit surface of the low beam distribution element is provided with an anti-reflection film, the high beam total reflection surface and/or an upper side surface of the high beam front-rear light channel is provided with a high-reflecting film, and the light exit surface of the high beam distribution element is provided with an anti-reflection film.

Optionally, the lens is a planoconvex lens or a biconvex lens.

Optionally, a light entrance surface and/or a light exit surface of the lens is provided with an anti-reflection film.

On the basis of the above technical solutions, the disclosure further provides a vehicle lamp, including the high and low beam integrated vehicle lamp lighting device according to any one of the above technical solutions.

On the basis of the above technical solution, the disclosure further provides a vehicle, including the vehicle lamp according to the above technical solution.

By adopting the above basic technical solutions of the disclosure, compared with the technical solution of the existing high and low beam integrated light emitting module in which the low beam light condenser and the high beam light condenser are superimposed up and down and structures of the low beam light condenser and the high beam light condenser both extend in the front-rear direction, the high and low beam integrated vehicle lamp lighting device of the disclosure using the light distribution element effectively enables the sizes of the low beam light-condensing structure and the high beam light-condensing structure formed by the first light-condensing element, the second light-condensing element and the light distribution element in the front-rear direction to be reduced, which is more conducive to the layout design in the vehicle lamp. Moreover, a distance between the first light source for forming the low beam and the second light source for forming the high beam is increased, so that the heat dissipation performance is effectively enhanced, and the overall size of the high and low beam integrated vehicle lamp lighting device can be reduced, which is convenient for miniaturization of the vehicle lamp.

Particularly, the light distribution element uses a bent structure, such as an L-shape structure, so that the size of the high and low beam integrated vehicle lamp lighting device in the front-rear direction is effectively reduced to some extent, and the vehicle lamp is more miniaturized.

Other features and advantages of the disclosure will be described in detail in the detailed description which follows.

BRIEF DESCRIPTION OF THE DRAWINGS

The following accompanying drawings serve to provide a further understanding of the disclosure and constitute a part of the description, and together with the following specific implementations, serve to explain the disclosure. However, the protection scope of the disclosure is not limited to the following accompanying drawings and specific implementations. In the accompanying drawings.

DESCRIPTION OF THE REFERENCE SIGNS

Figure 1:
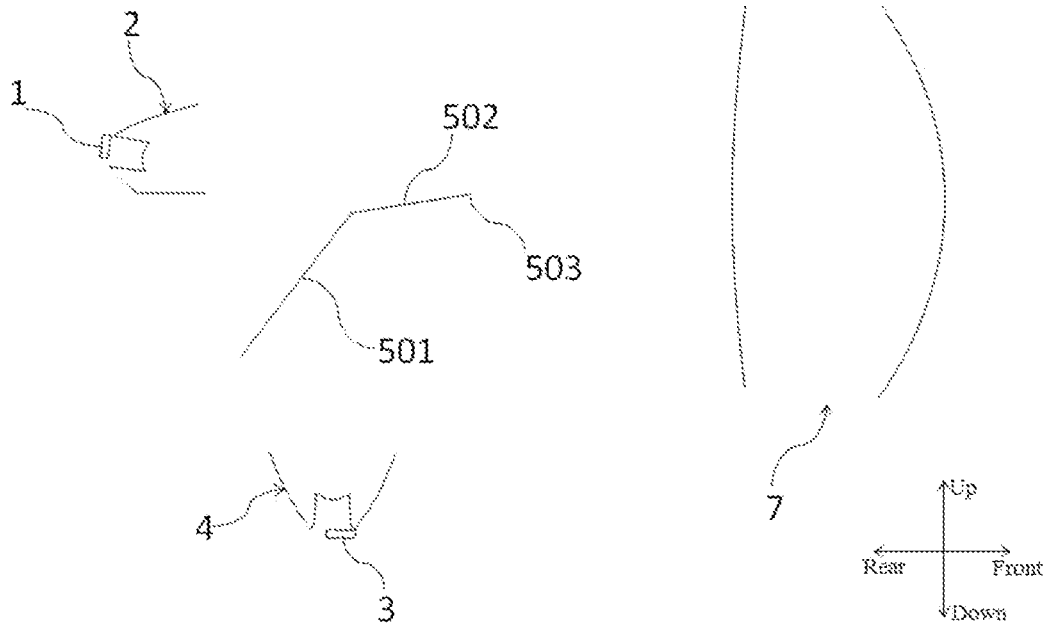
FIG. 1 is a schematic structural diagram I of a high and low beam integrated vehicle lamp lighting device according to a first specific implementation of the disclosure.

1 first light source; 2 first light-condensing element;
3 second light source; 4 second light-condensing element;
501 oblique reflecting surface; 502 front-rear extending reflecting surface;
503 cut-off boundary; 504 first light passing portion;
505 second light passing portion; 5051 first surface;
5052 second surface; 506 total reflection surface;
507 cut-off portion; 508 low beam distribution element;
5081 low beam up-down light channel 5082 low beam total reflection surface;
5083 low beam front-rear light channel 509 high beam distribution element;
5091 high beam up-down light channel 5092 high beam total reflection surface
5093 high beam front-rear light channel 6 III region forming portion
7 lens 700 low beam III region light shape
800 light shape below low beam cut-off line 900 low beam cut-off line
R1 low beam light R2 high beam light

DETAILED DESCRIPTION OF THE EMBODIMENTS

The specific implementations of the disclosure will be described in detail in conjunction with the accompanying drawings. It should be understood that the specific implementations described here are only used to illustrate and explain the disclosure, and the protection scope of the disclosure is not limited to the following specific implementations.

In addition, the terms "first" and "second" are only used for descriptive purposes, and cannot be understood as indicating or implying relative importance or implicitly indicating the number of technical features indicated. Therefore, the features defined with "first" and "second" may explicitly or implicitly include one or more of the features.

It should be understood that, in order to facilitate the description of the disclosure and simplify the description, the terms "front, rear" refer to the front-rear direction of the high and low beam integrated vehicle lamp lighting device along the light exit direction thereof, for example, in FIG. 1, the light distribution element is located at the rear, and correspondingly, the lens 7 is located at the front, the terms "left, right" refer to the left-right direction of the high and low beam integrated vehicle lamp lighting device along the light exit direction thereof, and the terms "up, down" refer to the up-down direction of the high and low beam integrated vehicle lamp lighting device along the light exit direction thereof. Generally, the front-rear, left-right and up-down directions of the high and low beam integrated vehicle lamp lighting device of the disclosure are substantially the same as the front-rear, left-right and up-down directions of the vehicle. The terms are based on the orientation or positional relationship shown in the accompanying drawings, rather than indicating or implying that the device or element referred to must have a specific orientation or be constructed and operated in a specific orientation, and therefore cannot be construed as a limitation of the disclosure. The orientation terms of the high and low beam integrated vehicle lamp lighting device of the disclosure should be understood in combination with the actual mounting state.

As shown in FIG. 1 to FIG. 28, a high and low beam integrated vehicle lamp lighting device according to a basic implementation of the disclosure includes at least one first light source 1, at least one first light-condensing element 2, at least one second light source 3, at least one second light-condensing element 4, a light distribution element and a lens 7, wherein the first light-condensing element 2 is arranged to be capable of condensing light emitted by the corresponding first light source 1 and making the light projected through the lens 7 by means of the light distribution element to form a low beam shape, and the second light-condensing element 4 is arranged to be capable of condensing light emitted by the corresponding second light source 3 and making the light projected through the lens 7 by means of the light distribution element to form a high beam shape; wherein the light exit direction of at least one of the first light-condensing element 2 and the second light-condensing element 4 intersects with a light shape projection direction.

Figure 9:
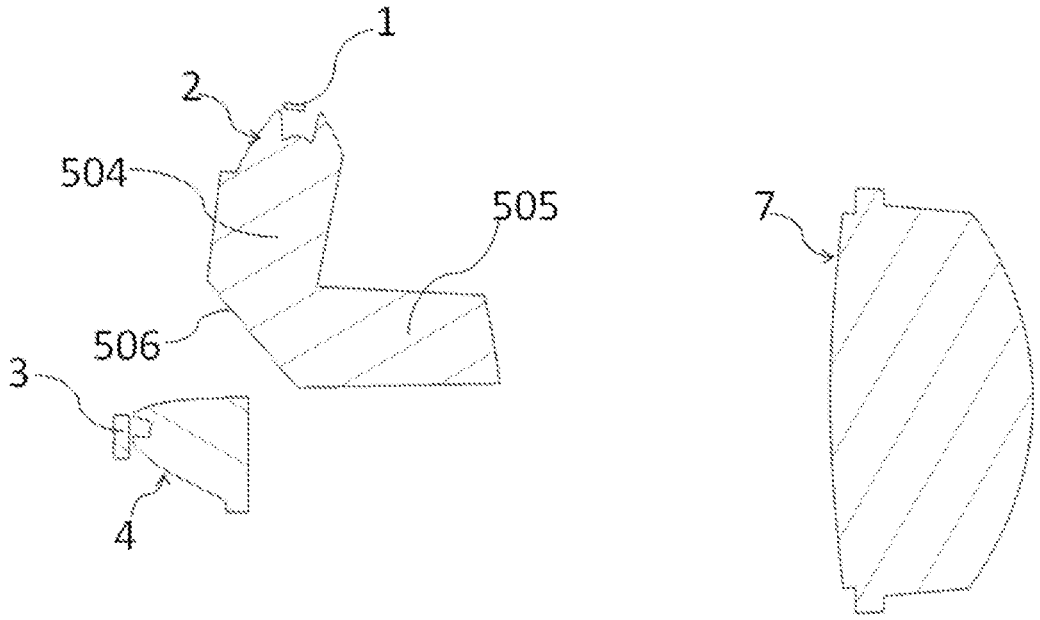
FIG. 9 is a schematic structural diagram III of the high and low beam integrated vehicle lamp lighting device according to the third specific implementation of the disclosure.
Figure 12:
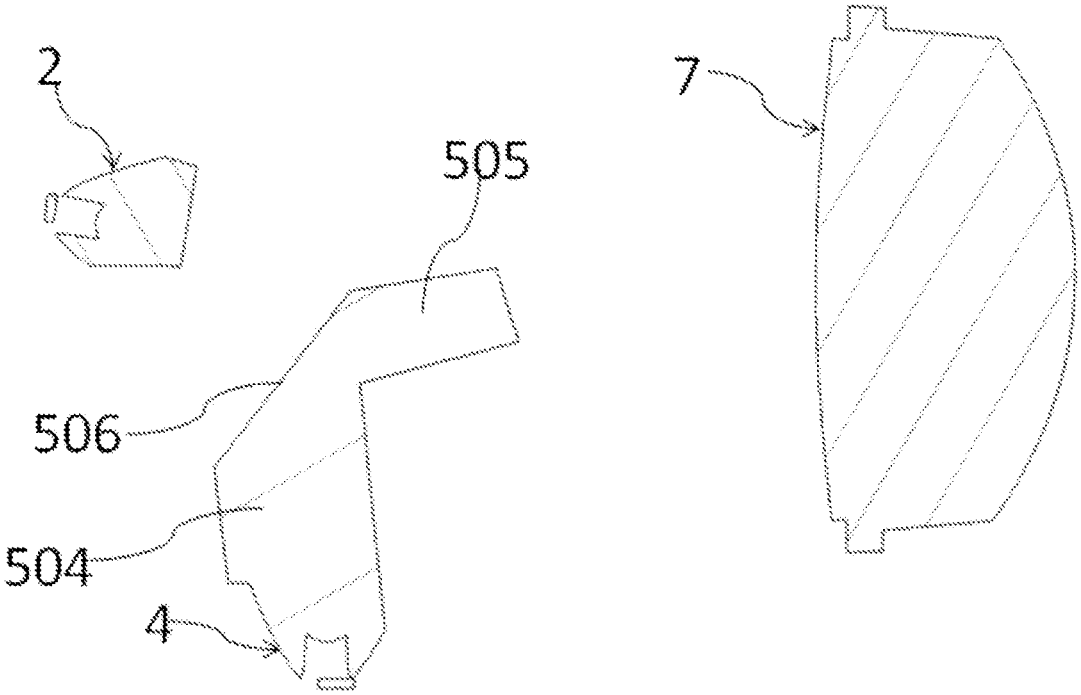
FIG. 12 is a schematic structural diagram III of the high and low beam integrated vehicle lamp lighting device according to the fourth specific implementation of the disclosure.
Figure 19:
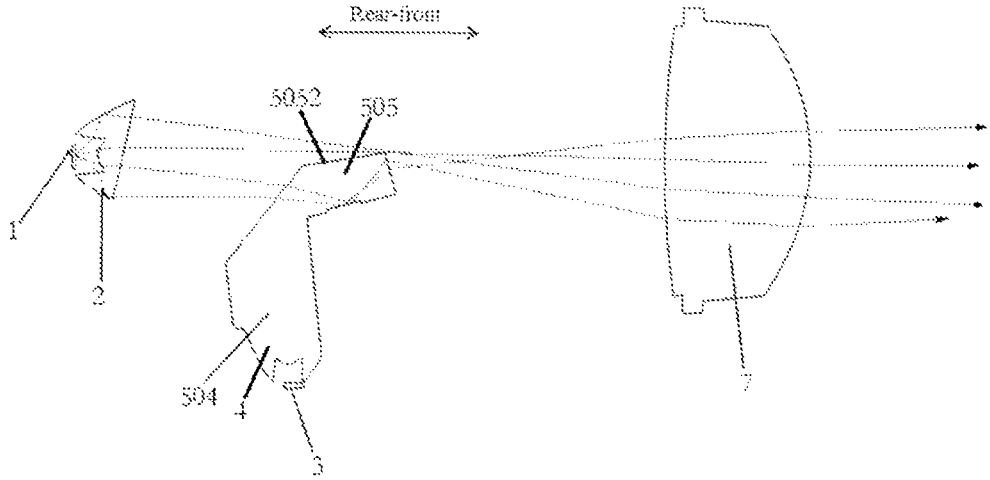
FIG. 19 is a schematic structural diagram II of the high and low beam integrated vehicle lamp lighting device according to the fifth specific implementation of the disclosure, in which a low beam light path is shown.
Figure 21:
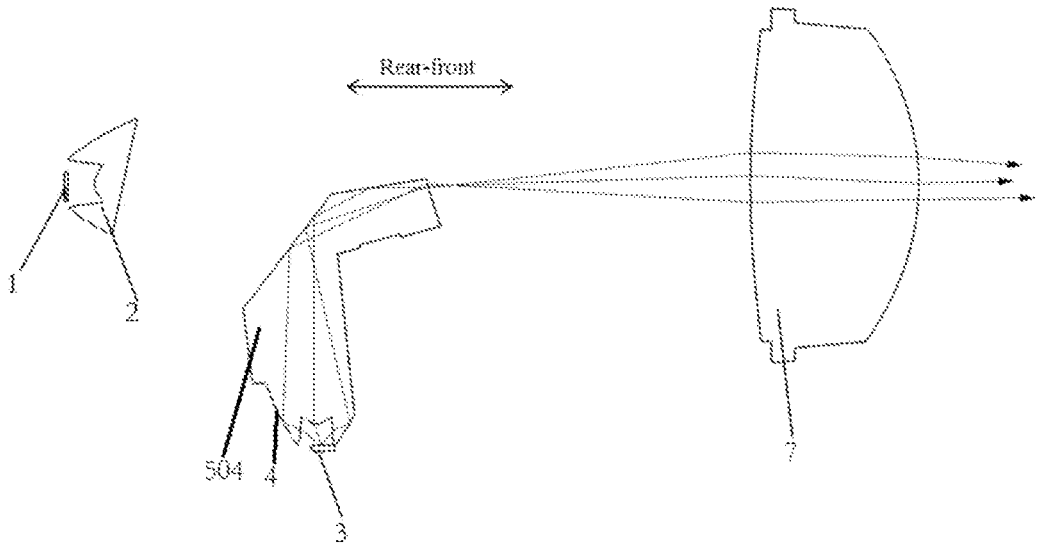
FIG. 21 is a schematic structural diagram III of the high and low beam integrated vehicle lamp lighting device according to the fifth specific implementation of the disclosure, in which a high beam light path is shown.
Figure 28:
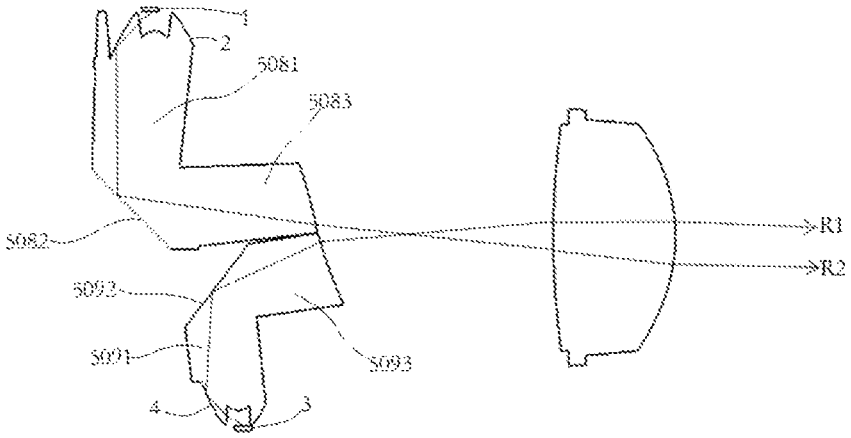
FIG. 28 is a schematic structural diagram IV of the high and low beam integrated vehicle lamp lighting device according to the seventh specific implementation of the disclosure.

Wherein, by setting the positional relationship between the first light-condensing element 2, the second light-condensing element 4 and the light distribution element, the light exit direction of at least one of the first light-condensing element 2 and the second light-condensing element 4 intersects with the light shape projection direction. Here, the "light shape projection direction" refers to a direction in which light exits from a light exit surface of the lens 7. The above "the light exit direction of at least one of the first light-condensing element 2 and the second light-condensing element 4 intersects with the light shape projection direction" means that light of at least one of the first light-condensing element 2 and the second light-condensing element 4 propagates generally along the up-down direction, as shown in FIG. 19 and FIG. 21, light of the other may propagate generally along the front-rear direction, or as shown in FIG. 28, light of the two may propagate generally along the up-down direction as long as the corresponding low beam shape and high beam shape should be obtained. Generally, since structures of the low beam light condenser and the high beam light condenser in the high and low beam integrated light emitting module in the prior art are both designed to extend in the front-rear direction, it can be considered that the light exit direction of the light-condensing element in the high and low beam integrated light emitting module in the prior art is approximately parallel to the light shape projection direction of the light emitted through the light exit surface of the lens, so that the size of the module in the front-rear direction is very large and the arrangement in the lamp has certain limitations. However, through the design of the above basic implementation, the size of the high and low beam integrated vehicle lamp lighting device of the disclosure in the front-rear direction can be well reduced, so that the high and low beam integrated vehicle lamp lighting device is more miniaturized. At the same time, a distance between the first light source 1 and the second light source 3 is increased, that is, a certain distance is left between the first light source 1 and the second light source 3, so that the light sources are arranged dispersedly, and the size of a radiator matched therewith can be decreased correspondingly, thereby improving the overall heat dissipation performance and realizing the technical effects of small size and light weight. It should be noted that the above "the first light-condensing element 2 is arranged to be capable of condensing light emitted by the corresponding first light source 1 and making the light projected through the lens 7 by means of the light distribution element to form a low beam shape, and the second light-condensing element 4 is arranged to be capable of condensing light emitted by the corresponding second light source 3 and making the light projected through the lens 7 by means of the light distribution element to form a high beam shape" means that the first light-condensing element 2 and the second light-condensing element 4 can form the corresponding low beam shape and high beam shape by using the light distribution element. In the process of forming the light shape, there are many forms. For example, as shown in FIG. 9, the light condensed by the first light-condensing element 2 propagates through the inside of the light distribution element and is projected through the lens 7 to form the low beam shape, while the light condensed by the second light-condensing element 4 directly propagates from the lower part of the light distribution element to the lens 7 and is projected through the lens 7 to form the high beam shape; or as shown in FIG. 12, the light condensed by the first light-condensing element 2 is intercepted by a cut-off portion 507 on the light distribution element and projected through the lens 7 to form the low beam shape, and the light condensed by the second light-condensing element 4 propagates through the inside of the light distribution element and is projected through the lens 7 to form the high beam shape. In other words, as long as the first light-condensing element 2 and the second light-condensing element 4 can form the corresponding low beam shape and high beam shape through the light distribution element.

Figure 2:
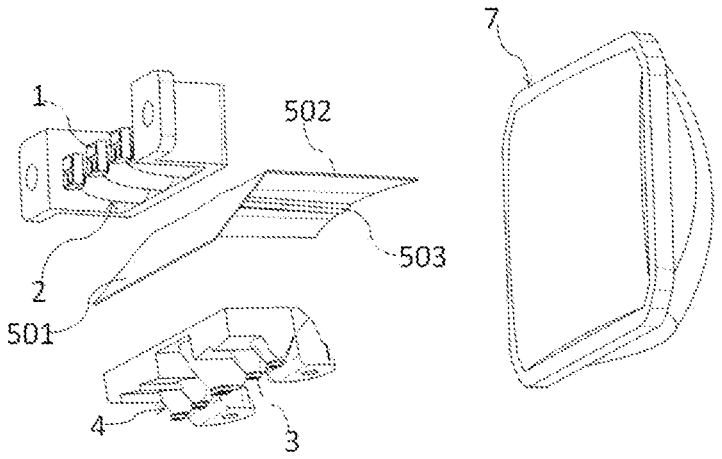
FIG. 2 is a schematic structural diagram II of the high and low beam integrated vehicle lamp lighting device according to the first specific implementation of the disclosure.

It can be understood that the number of the first light sources 1 and the number of the second light sources 3 can be set according to design requirements. FIG. 2 shows an example in which the number of the first light sources 1 and the number of the second light sources 3 are plural.

The disclosure can realize the technical effect of reducing the size in the front-rear direction through various specific structures of light distribution elements.

Figure 3:
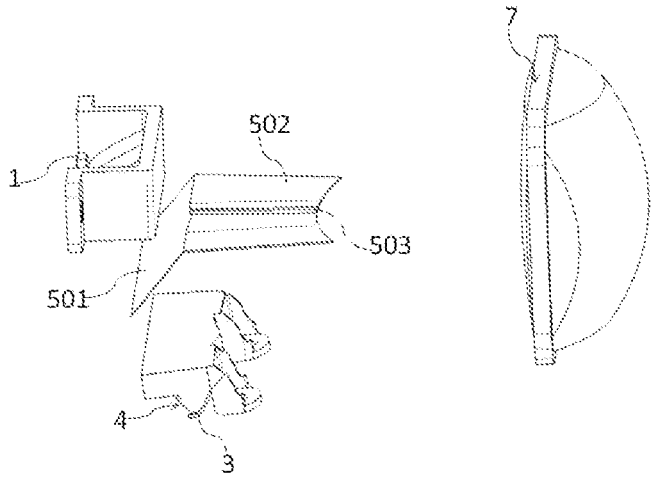
FIG. 3 is a schematic structural diagram III of the high and low beam integrated vehicle lamp lighting device according to the first specific implementation of the disclosure.

As a specific embodiment, as shown in FIG. 1 to FIG. 3, the light distribution element is bent, and includes an oblique reflecting surface 501 and a front-rear extending reflecting surface 502, the oblique reflecting surface 501 and the front-rear extending reflecting surface 502 are connected to form a bent structure, and a front end of the front-rear extending reflecting surface 502 is provided with a cut-off boundary 503. Thus, the first light-condensing element 2 condenses light emitted from the corresponding first light source 1, and then enables the light to propagate generally along the front-rear direction, the light emitted to the cut-off boundary 503 is projected through the lens 7 to form a low beam cut-off line in a set shape, and the light propagating in the front-rear direction is finally projected forward through the lens 7 to form the low beam shape of the vehicle. The second light-condensing element 4 condenses light emitted from the corresponding second light source 3, and then enables the light to propagate generally along the up-down direction, the light is reflected by the oblique reflecting surface 501 to the lens 7 directly, or to the lens 7 after being reflected by the front-rear extending reflecting surface 502, and finally, is projected forward through the lens 7 to form the high beam shape of the vehicle. It should be noted that the above "the first light-condensing element 2 condenses light emitted from the corresponding first light source 1, and then enables the light to propagate generally along the front-rear direction" means that according to the needs of light distribution, the light may propagate along the front-rear direction, or the light propagation direction may slightly deviate from the front-rear direction as long as the light is finally projected forward through the lens 7 to form the low beam shape with the low beam cut-off line in the set shape. Similarly, the above "the second light-condensing element 4 condenses light emitted from the corresponding second light source 3, and then enables the light to propagate generally along the up-down direction" means that according to the needs of light distribution, the light may propagate along the up-down direction, or the light propagation direction has a certain deviation from the up-down direction, as long as the light can be reflected by the oblique reflecting surface 501 and finally projected forward through the lens 7 to form the high beam shape of the vehicle by adjusting the inclination angle of the oblique reflecting surface 501.

Specifically, the light distribution element is a bent plate, the oblique reflecting surface 501 and the front-rear extending reflecting surface 502 are formed on an outer surface or an inner surface of the light distribution element, and the cut-off boundary 503 is formed on an upper edge of the front end of the light distribution element. A plate thickness of the light distribution element is not less than 0.1 mm and not greater than 2 mm. Preferably, the plate thickness of the light distribution element is not less than 0.1 mm and not greater than 0.5 mm. Wherein, the cut-off boundary 503 is formed at the front end of the front-rear extending reflecting surface 502. Further, the front end of the front-rear extending reflecting surface 502 may be designed as a concave arc shape to be able to form a clear light shape. The principle lies in that: the concave arc shape is a concave arc shape adapted to the focal plane of the lens 7, and the so-called focal plane refers to a plane orthogonal to the optical axis of the lens 7. However, due to the phase difference in field curvature, the focal plane of the lens 7 is actually a curved surface that is concave rearward, so that the closer the part of the front-rear extending reflecting surface 502 is to the focal plane, the clearer the light pixel formed by the light emitted through this part passing through the lens 7. Therefore, in order to be able to form a clear light shape, it is necessary to design the front end of the front-rear extending reflecting surface 502 into a concave arc shape which is the same or substantially the same as the focal plane of the lens 7.

Generally, the first light-condensing element 2 and the second light-condensing element 4 may be transparent optical elements, such as total internal reflection lenses that use the total reflection principle to collect and process light. According to the light energy distribution characteristics of the LED, discrete points on contour lines of the refracting surface and the reflecting surface of the total internal reflection lens are obtained by controlling the light path, a spline curve is obtained by interpolation, and then by rotating 360°, a model of the total internal reflection lens is obtained. While maintaining the small size of the lens, the light energy utilization rate is 95.26%.

Specifically, the first light-condensing element 2 and the second light-condensing element 4 may be in a light-condensing cup structure with a concave cavity in which a curved protrusion facing the light source is arranged. The light exit path can be controlled by adjusting the curvature of the side wall of the concave cavity and the curvature of the curved protrusion in the concave cavity to effectively adjust the energy distribution of the output light shape. The light-condensing elements have multiple adjustable structures, and are convenient for adjustment and more accurate in light shape control. Of course, the first light-condensing element 2 and the second light-condensing element 4 may be provided with no concave cavity inside, being only solid bodies of which the outer contour is a curved structure gradually increasing from the rear end to the front end, and the light entrance portion is of a light-condensing cup structure with a flat surface, a convex curved surface or a concave curved surface, so that the light can be better collected. The first light-condensing element 2 and the second light-condensing element 4 may be made of transparent plastic, glass or silicone, and the outer contour is a curved structure gradually increasing from the rear end to the front end, so that the light emitted from the corresponding light source can be well collected and collimated, thereby enhancing the light utilization rate.

In addition, a light exit surface of the first light-condensing element 2 and/or a light exit surface of the second light-condensing element 4 may be a grid surface to facilitate dimming and obtain a more uniform light shape. Wherein, the grid surface may be formed by splicing a plurality of flat surfaces or curved surfaces. Of course, in order to simplify the process, the light exit surface of the first light-condensing element 2 and the light-condensing element 4 may be a flat surface, as shown in FIG. 3, a plurality of first light-condensing elements 2 are connected integrally, and the light exit surfaces thereof form a common light exit flat surface.

Figure 4:
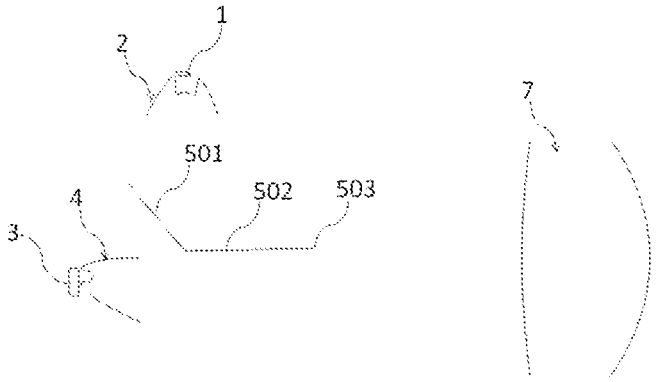
FIG. 4 is a schematic structural diagram I of the high and low beam integrated vehicle lamp lighting device according to a second specific implementation of the disclosure.
Figure 5:
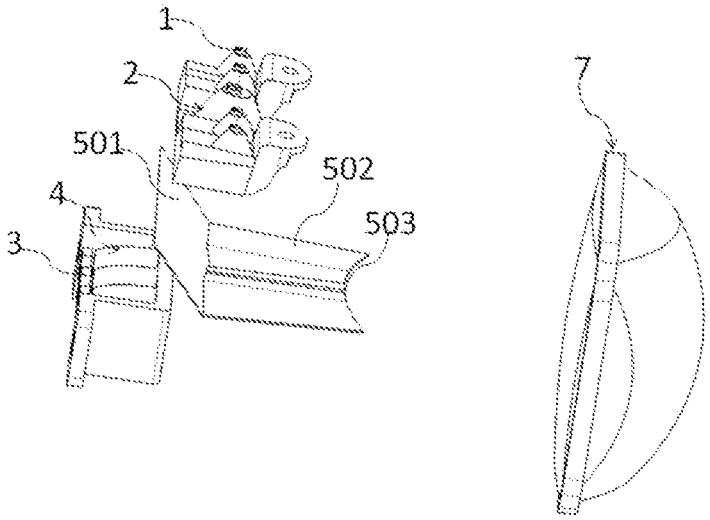
FIG. 5 is a schematic structural diagram II of the high and low beam integrated vehicle lamp lighting device according to the second specific implementation of the disclosure.
Figure 6:
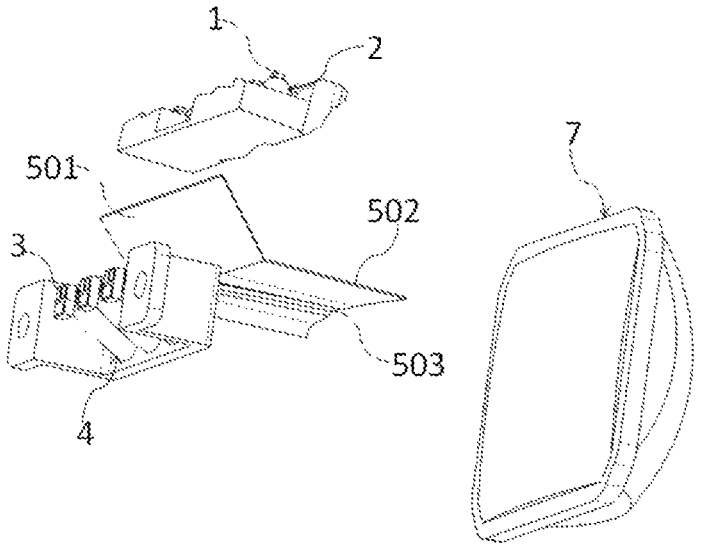
FIG. 6 is a schematic structural diagram III of the high and low beam integrated vehicle lamp lighting device according to the second specific implementation of the disclosure.

In the above embodiment, the front-rear extending reflecting surface 502 is located above the oblique reflecting surface 501 to form an approximately inverted L-shaped bent plate. Correspondingly, by simple changes, an approximately L-shaped bent plate as shown in FIG. 4 to FIG. 6, in which the front-rear extending reflecting surface 502 is located below the oblique reflecting surface 501, can be formed. The exit light of the first light-condensing element 2 propagates generally along the up-down direction, and the exit light is made to be capable of being reflected by the oblique reflecting surface 501, intercepted by the cut-off boundary 503 and finally projected through the lens 7 to form the low beam shape with a low beam cut-off line. The second light-condensing element 4 is located behind and below the light distribution element and is arranged to make exit light thereof projected through the lens 7 to form a high beam shape.

As another specific embodiment, as shown in FIG. 7 to FIG. 12, the light distribution element may also be a bent light guide element, including a first light passing portion 504 and a second light passing portion 505, the first light passing portion 504 is connected to the second light passing portion 505 through a total reflection surface 506 to form an L-shaped structure, and the second light passing portion 505 is provided with a cut-off portion 507 for forming a light shape cut-off line; wherein the first light-condensing element 2 is disposed on a light entrance surface of the first light passing portion 504 and is integrally formed with the first light passing portion 504; and the second light-condensing element 4 is located behind and below the light distribution element and is capable of making the exit light thereof projected through the lens 7 to form the high beam shape; or the second light-condensing element 4 is disposed on the light entrance surface of the first light passing portion 504 and is integrally formed with the first light passing portion 504; and the first light-condensing element 2 is located behind and above the light distribution element and is capable of making the exit light thereof intercepted by the cut-off portion 507 and projected through the lens 7 to form the low beam shape with the low beam cut-off line.

Figure 7:
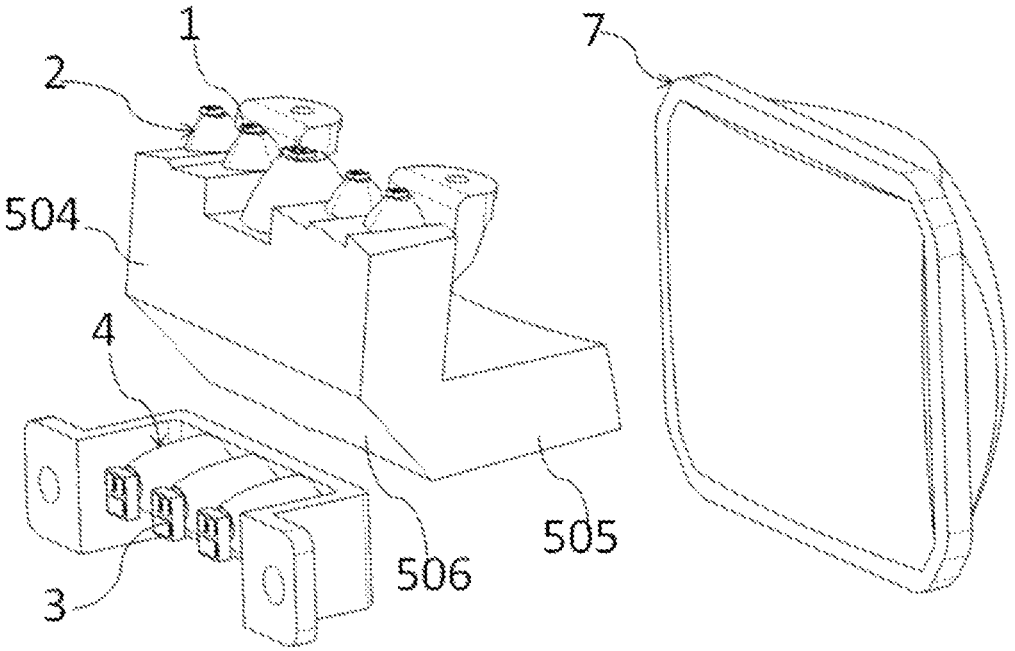
FIG. 7 is a schematic structural diagram I of the high and low beam integrated vehicle lamp lighting device according to a third specific implementation of the disclosure.
Figure 8:
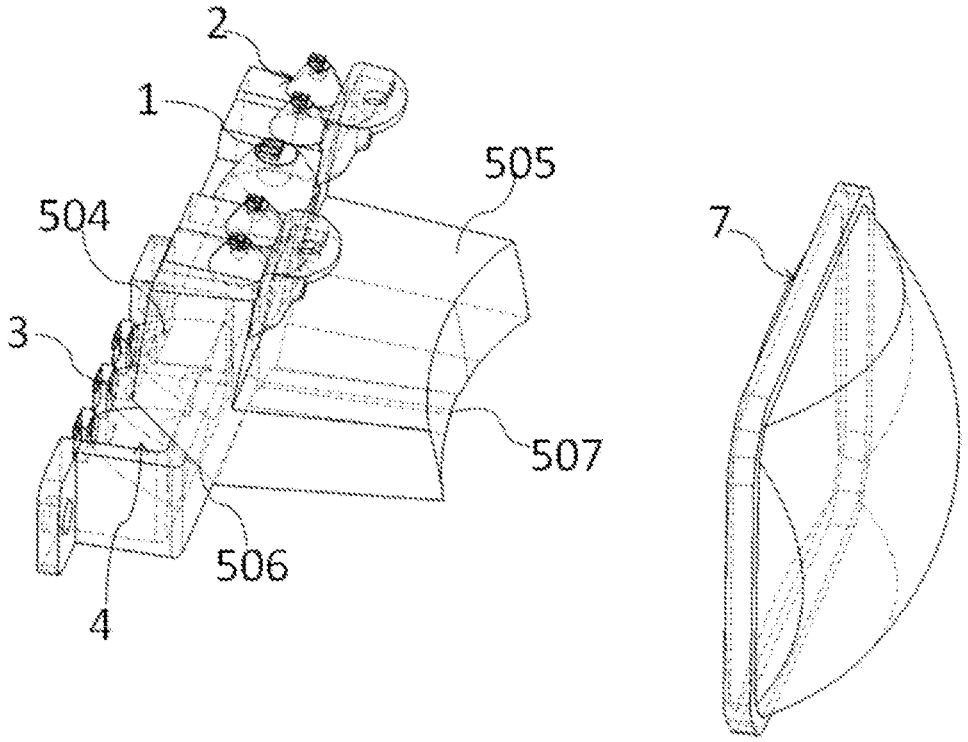
FIG. 8 is a schematic structural diagram II of the high and low beam integrated vehicle lamp lighting device according to the third specific implementation of the disclosure.

Specifically, as shown in FIG. 7 to FIG. 9, a plurality of first light-condensing elements 2 are sequentially arranged on the light entrance surface of the first light passing portion 504, and the first light-condensing elements 2 are integrally formed with the first light passing portion 504. Thus, the light emitted by the first light source 1 is condensed by the first light-condensing elements 2, reflected by the total reflection surface 506, emitted from the light exit surface located on the second light passing portion 505, intercepted by the cut-off portion 507, and finally emitted through the lens 7 to form the low beam shape with a low beam cut-off line. At the same time, a plurality of second light-condensing elements 4 are connected integrally, and the light emitted by the second light-condensing elements 4 can propagate from the lower part of the second light transmitting portion 505 and be emitted through the lens 7 to form the high beam shape. The first light-condensing elements 2 and the second light-condensing elements 4 are all transparent total internal reflection lenses.

Figure 10:
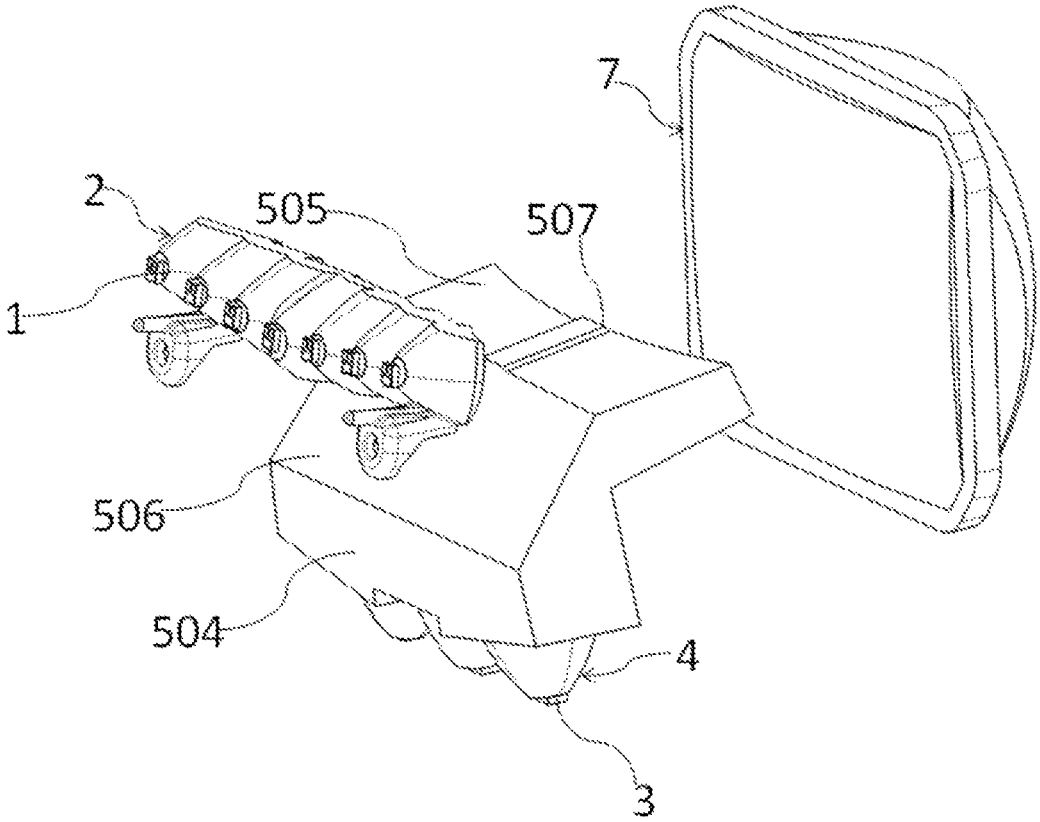
FIG. 10 is a schematic structural diagram I of the high and low beam integrated vehicle lamp lighting device according to a fourth specific implementation of the disclosure.
Figure 11:
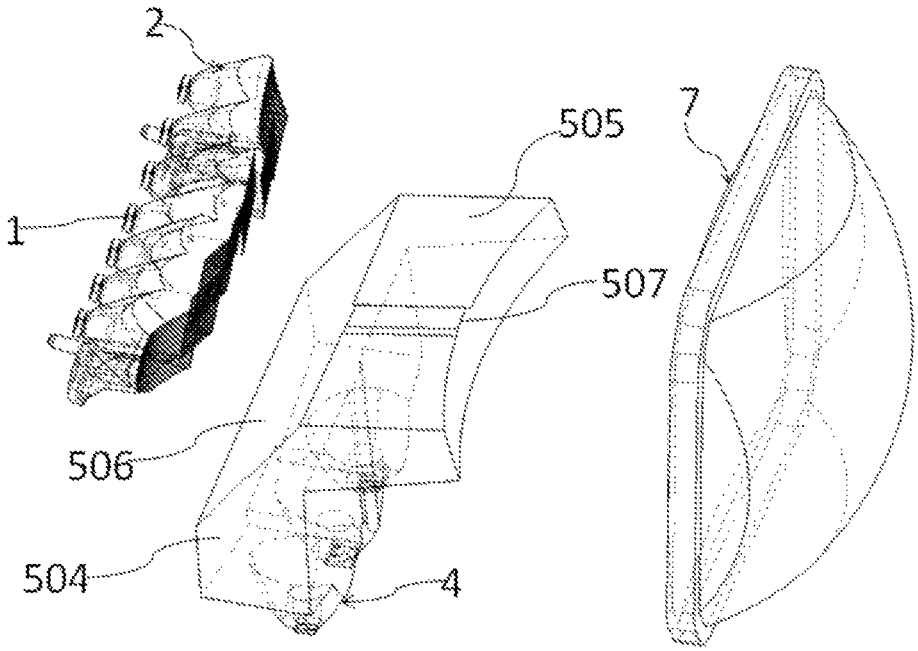
FIG. 11 is a schematic structural diagram II of the high and low beam integrated vehicle lamp lighting device according to the fourth specific implementation of the disclosure.

In addition, as shown in FIGS. 10 to 12, the second light-condensing elements 4 may also be formed integrally with the first light passing portion 504, that is, a plurality of second light-condensing elements 4 are sequentially arranged on the light entrance surface of the first light passing portion 504. Thus, light emitted by the first light-condensing elements 2 is intercepted by the cut-off portion 507 and finally emitted through the lens 7 to form the low beam shape with a low beam cut-off line. The light emitted by the second light-condensing elements 4 enters the first light passing portion 504, and is reflected by the total reflection surface 506, emitted from the light exit surface located on the second light passing portion 505 and finally emitted through the lens 7 to form the high beam shape. Similarly, the first light-condensing elements 2 and the second light-condensing elements 4 are all transparent total internal reflection lenses, and the light exit surface of the first light-condensing element 2 is a grid surface so as to obtain a uniform light shape.

Figure 13:
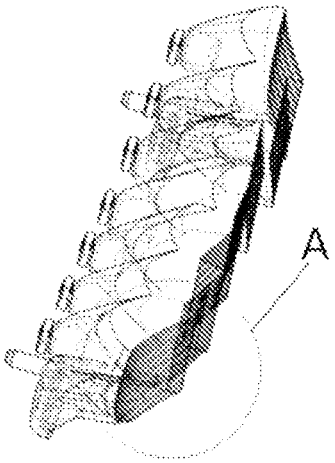
FIG. 13 is a schematic structural diagram of a light-condensing element according to the fourth specific implementation of the disclosure.
Figure 14:
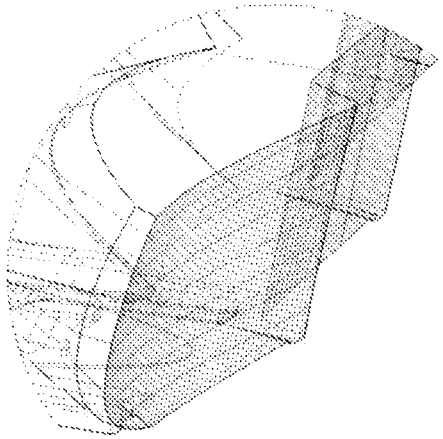
FIG. 14 is a partial enlarged detail of a part A in the implementation of FIG. 13.

Wherein, for the specific structural form of the grid surface, reference may be made to FIG. 13 and FIG. 14.

Further, as shown in FIG. 7, when the first light-condensing elements 2 are formed integrally with the first light passing portion 504, the front-rear extending reflecting surface 502 is formed on a lower surface of the second light passing portion 505, and the cut-off boundary 503 is formed at a front edge of the lower surface of the second light passing portion 505, thereby forming the cut-off portion 507. The light emitted by the first light-condensing elements 2 is reflected by the total reflection surface 506 with the same function as the oblique reflecting surface 501, and thus, is intercepted by the cut-off portion 507 and emitted through the lens 7 to form the low beam shape. As shown in FIG. 10, when the second light-condensing elements 4 are formed integrally with the first light passing portion 504, the front-rear extending reflecting surface 502 is formed on an upper surface of the second light passing portion 505, and the cut-off boundary 503 is formed at a front edge of the upper surface of the second light passing portion 505, thereby forming the cut-off portion 507. The light emitted by the second light-condensing elements 4 is reflected by the total reflection surface 506 with the same function as the oblique reflecting surface 501, and is finally emitted through the lens 7 to form the high beam shape.

Chinese patent No. CN106122870B discloses an LED-light-source high and low beam integrated vehicle lamp module. A III region forming structure of the LED-light-source high and low beam integrated vehicle lamp module is disposed on an upper surface of a light condenser. Low beam light propagates from the upper part of the light condenser, so the III region forming structure may block a part of the low beam light or change the propagation path of a part of the low beam light. This part of light is the part of light close to the low beam cut-off line, which may affect the performance of the low beam, for example, reduce the brightness of the 75R test point. In addition, the upper surface of the light condenser is a total reflection surface of the high beam. Disposing the III region forming structure on the upper surface of the light condenser may change the angle of part of the total reflection surface, which will change the total reflection light path of the high beam and lower the performance of the high beam.

Figure 20:
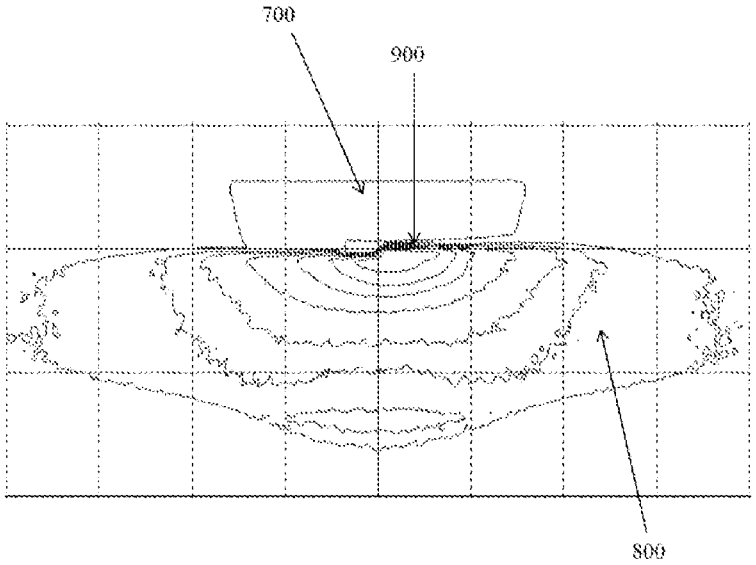
FIG. 20 is a schematic diagram of a light shape effect of a low beam shape and a low beam III region light shape formed by the high and low beam integrated vehicle lamp lighting device according to the fifth specific implementation of the disclosure.

Therefore, as shown in FIG. 15 to FIG. 24, a III region forming portion 6 may be disposed on the light distribution element. The III region forming portion 6 is located on a first surface 5051 or a second surface 5052 disposed oppositely on the second light passing portion 505. As shown in FIG. 20, the III region forming portion 6 is used to form a low beam III region light shape 700. Wherein, the first surface 5051 is a surface located on an inner side of the L shape on the second light passing portion 505, so that the III region forming portion 6 will not block the low beam light or change the propagation path of the high and low beam light, thereby enhancing the performance of the high beam and low beam.

Figure 15:
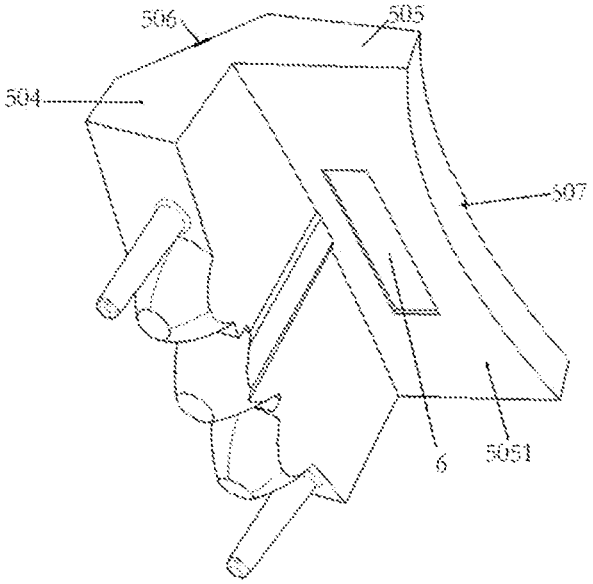
FIG. 15 is a schematic structural diagram I of a light distribution element and a light-condensing element connected integrally according to the specific implementation of the disclosure, in which a III region forming portion is a groove.

There are various specific structure forms of the III region forming portion 6 that can be used to form the low beam III region light shape 700. Specifically, as shown in FIG. 15, the III region forming portion 6 is disposed on the first surface 5051, and the III region forming portion 6 is a groove. Specifically, as shown in FIG. 19, the light emitted by the first light source 1 enters the L-shaped light distribution element, is reflected by a bottom surface of the groove to the light exit surface of the second light passing portion 505 and then to the lens 7, and is refracted through the lens 7 to form the low beam III region light shape 700. The bottom surface of the groove is capable of totally reflecting most of the light, thereby improving the brightness and uniformity of the low beam.

Figure 16:
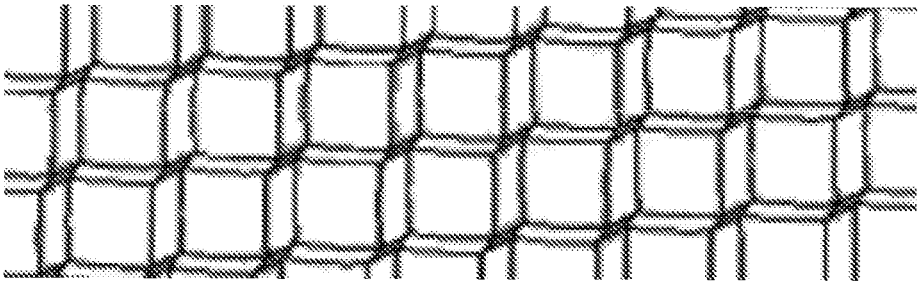
FIG. 16 is a schematic structural diagram of a grid pattern on the III region forming portion according to the specific implementation of the disclosure.
Figure 17:
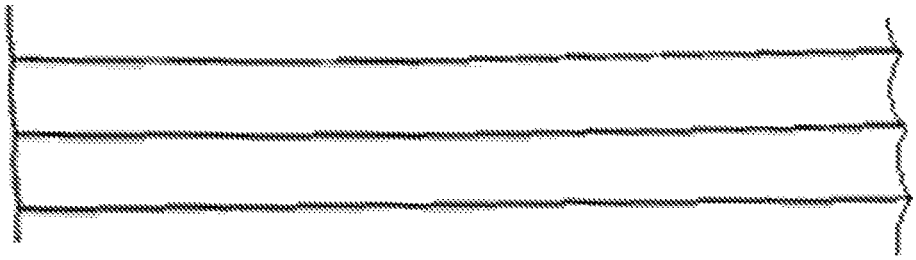
FIG. 17 is a schematic structural diagram of a strip pattern on the III region forming portion according to the specific implementation of the disclosure.

Wherein, the bottom surface of the groove is an upper end surface of the groove shown in FIG. 19, which may be a flat surface or a curved surface. Preferably, the bottom surface of the groove is provided with a grid pattern or a strip pattern to enhance the uniformity and illuminance of the low beam III region light shape 700. Exemplarily, as shown in FIG. 16, the grid pattern may be a plurality of regular curved surfaces having a segment difference, or a plurality of regular curved surfaces having no segment difference, such as a quadrilateral, which can enhance the uniformity and illumination of the low beam III region light shape 700. As shown in FIG.

17, the strip pattern may be cylindrical stripes, which may also achieve the above effect.

Figure 18:
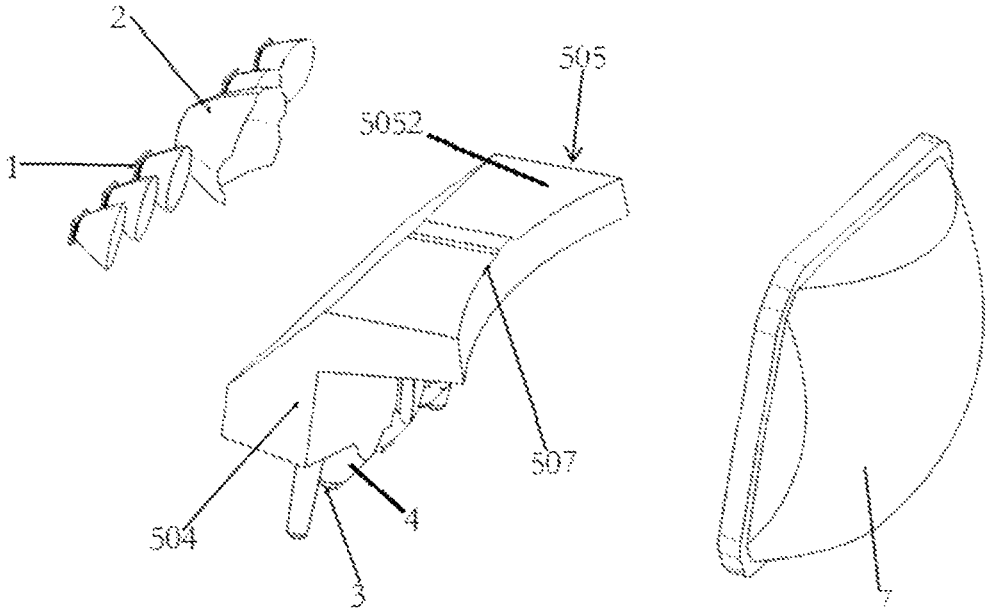
FIG. 18 is a schematic structural diagram I of the high and low beam integrated vehicle lamp lighting device according to a fifth specific implementation of the disclosure.

In a specific embodiment, as shown in FIG. 18, the first light source 1 is disposed behind the first light-condensing element 2, the second light-condensing element 4 is connected to the light entrance surface of the first light passing portion 504, and the second light source 3 is disposed below the second light-condensing element 4. By using the first light-condensing element 2, the second light-condensing element 4 and the light distribution element with a light-condensing structure, the optical utilization rate is greatly increased. The first light source 1 is far from the second light source 3, which facilitates heat dissipation.

As shown in FIG. 19 in combination with FIG. 20, the first light-condensing element 2 is configured as a low beam primary optical element of the high and low beam integrated vehicle lamp lighting device, an integral piece formed by the second light-condensing element 4 and the light distribution element is configured as a high beam primary optical element of the high and low beam integrated vehicle lamp lighting device, the lens 7 is a secondary optical element of the high and low beam integrated vehicle lamp lighting device, the light distribution element is disposed in an inverted L shape, and the light exit surface of the second light passing portion 505 of the light distribution element faces the lens 7. At the same time, as shown in FIG. 18, a front edge of the second surface 5052 of the second light passing portion 505 has the cut-off portion 507 for forming the low beam cut-off line 900, and light emitted to the cut-off portion 507 is refracted through the lens 7 to form the low beam cut-off line 900. By using the above light distribution element, the high and low beam integrated vehicle lamp lighting device provided by this embodiment can enhance the performance of the high beam and low beam. Moreover, the structure of the first light-condensing element 2 occupies a small space, and the L-shaped light distribution element also greatly reduces the size in the front-rear direction, so that the size of the vehicle lamp is greatly reduced.

The arrowed lines in FIG. 19 represent light paths of a light shape below the low beam cut-off line 800 and the low beam III region light shape 700. In short, a part of light emitted by the first light source 1 is condensed by the first light-condensing element 2, emitted through the upper part of the second light passing portion 505 to the lens 7, and refracted by the lens 7 to form the light shape below the low beam cut-off line 800, and the other part of the light is condensed by the first light-condensing element 2, emitted into the light distribution element and to the III region forming portion 6, reflected by the III region forming portion 6, emitted from the light exit surface of the second light passing portion 505, and refracted through the lens 7 to form the low beam III region light shape 700. As shown in FIG. 20, a schematic diagram of the light shape below the low beam cut-off line 800 and a schematic diagram of the low beam III region light shape 700 are shown.

The arrowed lines in FIG. 21 represent light paths of the high beam shape. In short, light emitted by the second light source 2 is condensed by the second light-condensing element 4, emitted into the light distribution element, reflected by the total reflection surface 506 of the light distribution element to the light exit surface of the second light passing portion 505, and refracted by the lens 7 to form the high beam shape.

Figure 22:
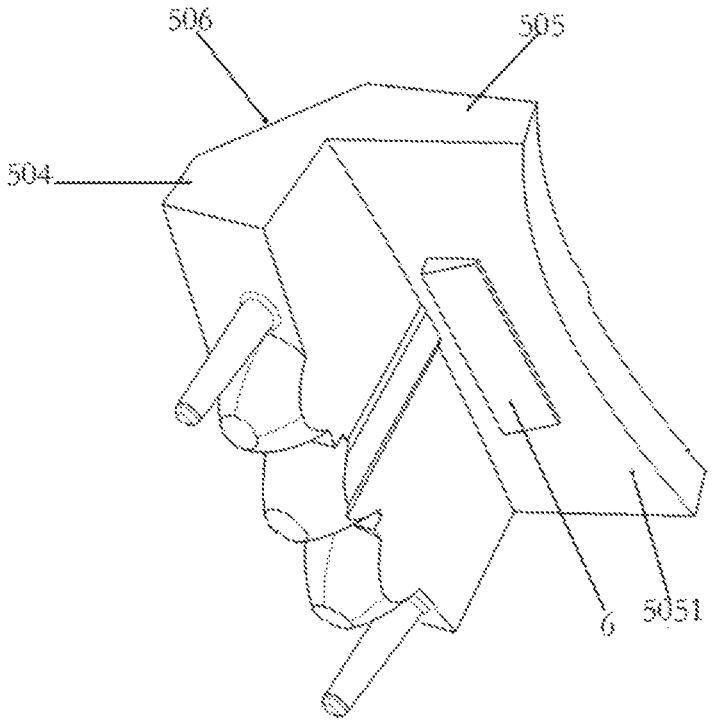
FIG. 22 is a schematic structural diagram II of the light distribution element and the light-condensing element connected integrally according to the specific implementation of the disclosure, in which a III region forming portion is a protrusion.

In addition, as shown in FIG. 22, the III region forming portion 6 is disposed on the first surface 5051, the III region forming portion 6 is a protrusion, and a surface of the protrusion opposite to the first surface 5051 is disposed at an included angle with the first surface 5051 so as to adjust a propagation direction of III region light irradiated thereon. Similarly, the surface of the protrusion opposite to the first surface 5051 may also be provided with a grid pattern or a strip pattern to enhance the uniformity and illuminance of the low beam III region light shape 700.

Figure 23:
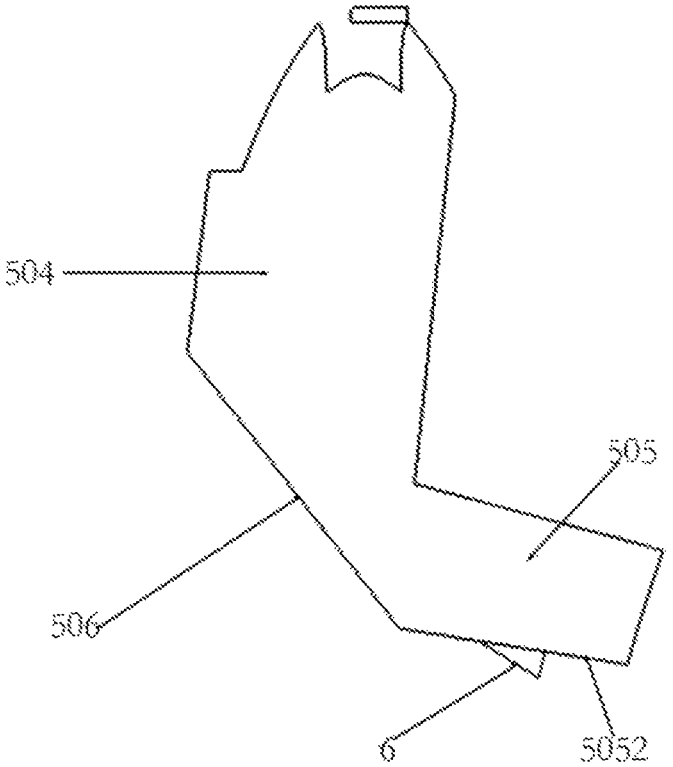
FIG. 23 is a schematic structural diagram III of the light distribution element and the light-condensing element connected integrally according to the specific implementation of the disclosure, in which a III region forming portion is a triangular protrusion.

Further, as shown in FIG. 23, the III region forming portion 6 is disposed on the second surface 5052, the III region forming portion 6 is a protrusion, and a cross section of the protrusion is preferably triangular. Light emitted by the first light source 1 is condensed by the second light-condensing element 4 and emitted into the light distribution element, a part of the light is reflected by the total reflection surface 506 to the light exit surface of the second light passing portion 505 and emitted therefrom, and the other part of the light is reflected by the total reflection surface 506 to a front side surface of the protrusion and emitted therefrom, and is refracted through the lens 7 to form the low beam III region light shape 700.

Figure 24:
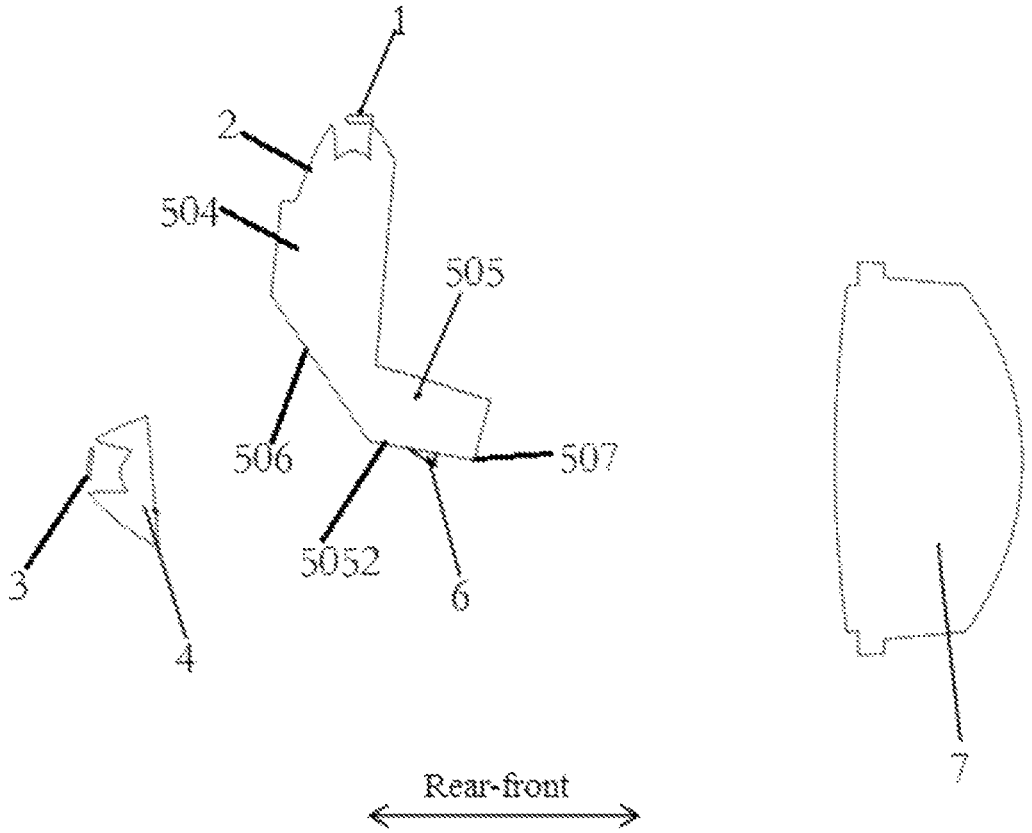
FIG. 24 is a schematic structural diagram of the high and low beam integrated vehicle lamp lighting device according to a sixth specific implementation of the disclosure.
Figure 25:
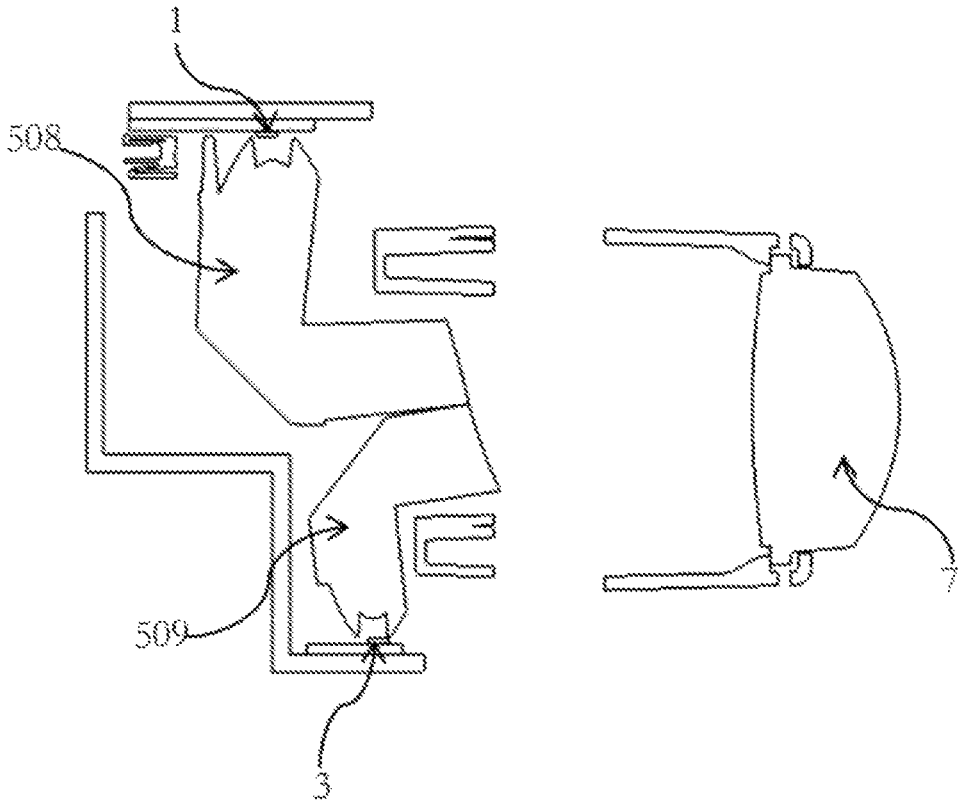
FIG. 25 is a schematic structural diagram I of the high and low beam integrated vehicle lamp lighting device according to a seventh specific implementation of the disclosure.

As another specific embodiment, as shown in FIG. 24, the first light source 1 is disposed corresponding to the first light-condensing element 2, and the first light-condensing element 2 is connected to a light entrance surface of the first light passing portion 504 of the light distribution element. The second light source 3 is disposed corresponding to the second light-condensing element 4 and located behind and below the light distribution element.

In this embodiment, the second light-condensing element 4 is configured as a high beam primary optical element of the high and low beam integrated vehicle lamp lighting device, the integral piece formed by the first light-condensing element 2 and the light distribution element is configured as a low beam primary optical element of the high and low beam integrated vehicle lamp lighting device, the light distribution element is disposed in an L shape, and the light exit surface of the second light passing portion 505 of the light distribution element faces the lens 7. At the same time, a front edge of the second surface 5052 of the second light passing portion 505 has the cut-off portion 507 for forming the low beam cut-off line 900, and light emitted to the cut-off portion 507 is refracted through the lens 7 to form the low beam cut-off line 900.

Light emitted by the first light source 1 enters the light distribution element through the first light-condensing element 2, a part of the light is reflected by the total reflection surface 506 to the light exit surface of the second light passing portion 505, emitted to the lens 7, and refracted through the lens 7 to form the light shape below the low beam cut-off line 800, and the other part of the light is reflected by the total reflection surface 506 to the III region forming portion 6, emitted from a front side surface of the III region forming portion 6 to the lens 7, and refracted through the lens 7 to form the low beam III region light shape 700. Light emitted by the second light source 3 is condensed by the second light-condensing element 4, emitted through the lower part of the second light passing portion 505 to the lens 7, and refracted by the lens 7 to form the high beam shape.

Wherein, the light exit surface of the second light passing portion 505 may be set as a concave curved surface to be capable of forming a clear light shape. The principle lies in that: the concave curved surface is adapted to the focal plane of the lens 7, and the so-called focal plane refers to a plane orthogonal to the optical axis of the lens 7. However, due to the phase difference in field curvature, the focal plane of the lens 7 is actually a curved surface that is concave rearward, so that the closer the part of the light exit surface of the second light passing portion 505 is to the focal plane, the clearer the light pixel formed by the light emitted through this part passing through the lens 7. Therefore, in order to be able to form a clear light shape, it is necessary to design the light exit surface of the second light passing portion 505 into a concave curved surface which is the same or substantially the same as the focal plane of the lens 7.

As another specific embodiment, as shown in FIG. 25 to FIG. 28, the light distribution element includes an L-shaped low beam distribution element 508 and an L-shaped high beam distribution element 509, the low beam distribution element 508 is disposed corresponding to each of the first light-condensing elements 2, and the high beam distribution element 509 is disposed corresponding to each of the second light-condensing elements 4.

Wherein, the optical axis direction of the first light source 1 is the up-down direction, and the light emitting direction faces downward. The low beam distribution element 508 is of an L shape, with one end facing upward and connected to the first light-condensing element 2 and the other end facing forward. The first light source 1 is disposed above the first light-condensing element 2, and the bend of the low beam distribution element 508 has a low beam total reflection surface 5082. The optical axis direction of the second light source 3 is the up-down direction, and the light emitting direction faces upward. The high beam distribution element 509 is of an inverted L shape, with one end facing downward and connected to the second light-condensing element 4 and the other end facing forward. The first light source 3 is disposed below the second light-condensing element 4, and the bend of the high beam distribution element 509 has a low beam total reflection surface 5092. To some extent, the low beam distribution element 508 and the high beam distribution element 509 reduce the size of the high and low beam integrated vehicle lamp lighting device in the front-rear direction, and optimizes and improves the assembly size of the high and low beam integrated vehicle lamp lighting device, so that the high and low beam integrated vehicle lamp lighting device is more miniaturized. Moreover, the first light-condensing element 2 and the second light-condensing element 4 are respectively located at an upper part and a lower part of the space of the high and low beam integrated vehicle lamp lighting device, so that the first light source 1 and the second light source 3 are respectively correspondingly disposed at the upper part and the lower part of the space of the high and low beam integrated vehicle lamp lighting device. A certain distance is left between the first light source 1 and the second light source 3, and the low beam LED accounting for the main power is arranged at the upper part, so the heat dissipation performance is greatly improved. Due to the above special design, the size of the radiator matched therewith is correspondingly reduced, thereby realizing the advantages of small size, light weight and low cost.

Figure 26:
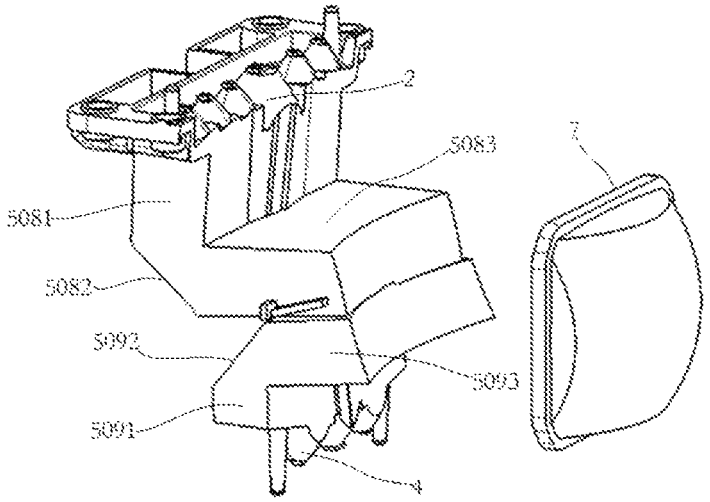
FIG. 26 is a schematic structural diagram II of the high and low beam integrated vehicle lamp lighting device according to the seventh specific implementation of the disclosure.
Figure 27:
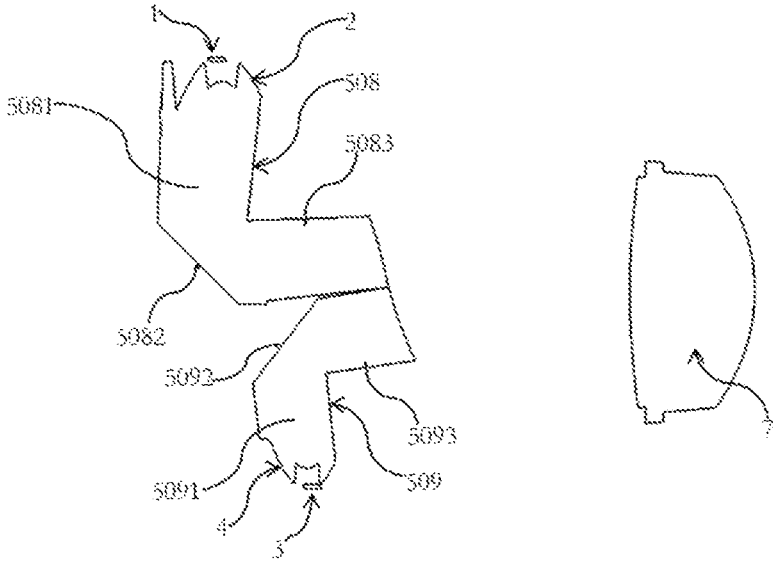
FIG. 27 is a schematic structural diagram III of the high and low beam integrated vehicle lamp lighting device according to the seventh specific implementation of the disclosure.

In a specific embodiment, as shown in FIG. 26, the low beam distribution element 508 includes a low beam up-down light channel 5081, a low beam total reflection surface 5082 and a low beam front-rear light channel 5083, the low beam up-down light channel 5081 is connected to the low beam front-rear light channel 5083 through the low beam total reflection surface 5082 to form an L-shaped structure, the low beam total reflection surface 5082 is disposed on an outer side of the corner where the two are connected, and a light entrance surface of the low beam up-down light channel 5081 is integrally provided with the first light-condensing elements 2. The high beam distribution element 509 includes a high beam up-down light channel 5091, a high beam total reflection surface 5092 and a high beam front-rear light channel 5093, the high beam up-down light channel 5091 is connected to the high beam front-rear light channel 5093 through the high beam total reflection surface 5092 to form an inverted L-shaped structure, the high beam total reflection surface 5092 is disposed at an outer side of the corner where the two are connected, and a light entrance surface of the high beam up-down light channel 5091 is integrally provided with the second light-condensing elements 4. Wherein, the low beam up-down channel 5081 and the high beam up-down channel 5091 both extend along the up-down direction, and the low beam front-rear light channel 5083 and the high beam front-rear light channel 5093 both extend along the front-rear direction.

Specifically, the front-rear extending reflecting surface 502 is formed on a lower surface of the low beam front-rear light channel 5083, the cut-off boundary 503 is formed at a front edge of the lower surface of the low beam front-rear light channel 5083, and light emitted by each of the first light-condensing elements 2 is reflected by the low beam total reflection surface 5082 with the same function as the oblique reflecting surface 501, and thus, is intercepted by the cut-off boundary 503 at the front edge of the lower surface of the low beam front-rear light channel 5083 and projected through the lens 7 to form the low beam shape with the low beam cut-off line. The front-rear extending reflecting surface 502 is formed on an upper surface of the high beam front-rear light channel 5093, the cut-off boundary 503 is formed at a front edge of the upper surface of the high beam front-rear light channel 5093, and light emitted by each of the second light-condensing elements 4 is reflected by the high beam total reflection surface 5092 with the same function as the oblique reflecting surface 501, and thus, is intercepted by the cut-off boundary 503 at the front edge of the upper surface of the high beam front-rear light channel 5093 and projected through the lens 7 to form the high beam shape with the high beam cut-off line. The upper and lower cut-off boundaries 503 are in contact.

As shown in FIG. 28, the light emitted by the first light source 1 is firstly refracted into the first light-condensing element 2, and continues to propagate downward in the low beam up-down channel 5081 after being refracted and reflected. Then, the light is totally reflected by the low beam total reflection surface 5082, propagates forward in the low beam front-rear light channel 5083, is refracted by the light exit surface of the low beam front-rear light channel 5083 into the lens 7, and is refracted through the lens 7 to form low beam light R2 which is emitted forward, thereby forming the low beam shape. The light emitted by the second light source 3 is firstly refracted into the second light-condensing element 4, and continues to propagate upward in the high beam up-down channel 5091 after being refracted and reflected. Then, the light is totally reflected by the high beam total reflection surface 5092, propagates forward in the high beam front-rear light channel 5093, is refracted through the light exit surface of the high beam front-rear light channel 5093 into the lens 7, and is refracted through the lens 5 to form high beam light R1 which is emitted forward, thereby forming the high beam shape.

In a specific embodiment, the low beam total reflection surface 5082 is a flat surface, a concave surface or a convex surface, and the high beam total reflection surface 5092 is a flat surface, a concave surface or a convex surface. The lower surface of the low beam front-rear light channel 5083 is a flat surface or a cambered surface, the diameter of the arc being 100 mm-500 mm. The upper surface of the high beam front-rear light channel 5093 is a flat surface or a cambered surface, the diameter of the arc being 100 mm-500 mm. wherein, the concave surface, the convex surface or the cambered surface may be used to adjust the reflectivity of the surface, the light shape of light distribution of the vehicle lamp, the shape of the light shape cut-off line and the like.

As shown in FIG. 26, a lower side line of a light exit surface of the low beam distribution element 508 is provided with a cut-off line structure used to form the low beam shape with a cut-off line, and the light exit surface of the low beam distribution element 508 is an arc surface, the diameter of the arc being 50 mm-300 mm. An upper side line of a light exit surface of the high beam distribution element 509 is provided with a cut-off line structure used to form the high beam shape with a cut-off line, and the light exit surface of the high beam distribution element 509 is an arc surface, the diameter of the arc being 50 mm-300 mm. Further, the lower side line of the light exit surface of the low beam distribution element 508 (that is, the cut-off boundary 503) is in contact with the upper side line of the light exit surface of the high beam distribution element 509 (that is, the cut-off boundary 503), a gap between a lower side of the low beam distribution element 508 and an upper side of the high beam distribution element 509 gradually increases from the contact position of the front end to the rear, and an intermediate air layer is wedge-shaped.

In order to enhance optical properties of the low beam distribution element 508 and the high beam distribution element 509, the low beam total reflection surface 5082 and/or a lower side surface of the low beam front-rear light channel 5083 is provided with a high-reflecting film, the light exit surface of the low beam distribution element 508 is provided with an anti-reflection film, the high beam total reflection surface 5092 and/or an upper side surface of the high beam front-rear light channel 5093 is provided with a high-reflecting film, and the light exit surface of the high beam distribution element 509 is provided with an anti-reflection film.

In a specific embodiment, the lens 7 may be a planoconvex lens, or the lens 7 may be a biconvex lens. By using the biconvex lens, the size of the lens is smaller, the sunlight focusing risk is lower, and the dispersion is better.

Further, the material of the lens 7 is PMMA with a refractivity of 1.49-1.51, and the light entrance surface and/or the light exit surface of the lens 7 is provided with an anti-reflection film.

In a specific embodiment, the number of the first light sources 1 is greater than or equal to 4, and the number of light source light emitting chips near the middle is greater than or equal to the number of light source light emitting chips on the two sides, so as to increase the brightness of the middle position of the light shape. The number of the second light sources 3 is greater than or equal to 2, the number of the first light-condensing elements 2 is greater than or equal to the number of the first light sources 1, and the number of the second light-condensing elements 4 is greater than or equal to the number of the second light sources 3.

Specifically, the first light source 1 and the second light source 3 are both LED light sources. The number of the LED light source light emitting chips of the first light source 1 near the middle is 3, and the rest are single-chip LED light sources. The number of the first light-condensing elements 2 is 6, and each of the first light sources 1 is surrounded by the corresponding first light-condensing element 2. The number of the second light-condensing elements 4 is 3, and each of the second light sources 1 is surrounded by the corresponding second light-condensing element 2.

It should be noted that the light source of the disclosure may adopt an LED light source, but is not limited to the LED light source only, and the use of a laser light source or other similar light sources shall also fall within the protection scope of the disclosure. There are multiple light sources that are disposed dispersedly, so that heat sources may be dispersed, thereby enhancing the heat dissipation performance. In addition, in a specific embodiment, the first light-condensing elements 2 may be disposed dispersedly or connected integrally. Similarly, the second light-condensing elements 4 may be disposed dispersedly or connected integrally.

The disclosure further provides a vehicle lamp, which may have the high and low beam integrated vehicle lamp lighting device according to any embodiment above, that is, use all technical solutions of all the embodiments of the high and low beam integrated vehicle lamp lighting device above, and therefore, has at least all beneficial effects brought by the technical solutions of the embodiments of the high and low beam integrated vehicle lamp lighting device above.

Further, a light propagation path is formed in the vehicle lamp. The vehicle lamp includes the high and low beam integrated vehicle lamp lighting device, a radiator and a lens mounting bracket. The high and low beam integrated vehicle lamp lighting device is mounted on the radiator and located in a cavity enclosed by the radiator and the lens mounting bracket. Thus, the vehicle lamp has a correspondingly reduced size and good heat dissipation performance.

The disclosure further provides a vehicle, which may have the vehicle lamp according to any embodiment above, that is, use all technical solutions of all the embodiments of the vehicle lamp above, and therefore, has at least all beneficial effects brought by the technical solutions of the embodiments of the vehicle lamp above.

The preferred implementations of the disclosure have been described in detail above in conjunction with the accompanying drawings, but the disclosure is not limited to the specific details in the above implementations, and various simple variations may be made to the technical solutions of the disclosure within the scope of the technical idea of the disclosure. These simple variations are all within the protection scope of the disclosure. It should be further noted that the specific technical features described in the above specific implementations may be combined in any suitable manner in the case of no contradiction. In order to avoid unnecessary repetition, the disclosure will not be further described in various possible combinations.

In addition, any combination of the various different implementations of the disclosure may be made as long as it does not deviate from the idea of the disclosure, and it should also be regarded as the contents of the disclosure.

The invention claimed is:

1. A high and low beam integrated vehicle lamp lighting device, comprising at least one first light source, at least one first light-condensing element, at least one second light source, at least one second light-condensing element, a light distribution element and a lens, wherein the first light-condensing element is arranged to be capable of condensing light emitted by the corresponding first light source and making the light projected through the lens by means of the light distribution element to form a low beam shape, and the second light-condensing element is arranged to be capable of condensing light emitted by the corresponding second light source and making the light projected through the lens by means of the light distribution element to form a high beam shape;

wherein the light exit direction of at least one of the first light-condensing element and the second light-condensing element intersects with a light shape projection direction;

wherein the light distribution element comprises an oblique reflecting surface and a front-rear extending reflecting surface, the oblique reflecting surface and the front-rear extending reflecting surface are connected to form a bent structure, and a front end of the front-rear extending reflecting surface is provided with a cut-off boundary;

the first light-condensing element is arranged to make exit light thereof intercepted by the cut-off boundary and projected through the lens to form the low beam shape with a low beam cut-off line, exit light of the second light-condensing element propagates along an up-down direction, and the second light-condensing element is arranged to make the exit light thereof reflected by the oblique reflecting surface to form the high beam shape; or the exit light of the first light-condensing element propagates along the up-down direction, the first light-condensing element is arranged to make the exit light thereof reflected by the oblique reflecting surface, intercepted by the cut-off boundary and finally projected through the lens to form the low beam shape with a low beam cut-off line, and the second light-condensing element is arranged to make the exit light thereof projected through the lens to form the high beam shape.

2. The high and low beam integrated vehicle lamp lighting device according to claim 1, wherein the light distribution element is a bent plate, the oblique reflecting surface and the front-rear extending reflecting surface are formed on an outer surface or an inner surface of the light distribution element, and the cut-off boundary is formed on an upper edge of a front end of the light distribution element.

3. The high and low beam integrated vehicle lamp lighting device according to claim 2, wherein a plate thickness of the light distribution element is not less than 0.1 mm and not greater than 2 mm.

4. The high and low beam integrated vehicle lamp lighting device according to claim 1, wherein a front end of the front-rear extending reflecting surface is of a concave arc shape.

5. The high and low beam integrated vehicle lamp lighting device according to claim 1, wherein the first light-condensing element and the second light-condensing element are both transparent total internal reflection lenses.

6. The high and low beam integrated vehicle lamp lighting device according to claim 5, wherein one or more of a light exit surface of the first light-condensing element and/or a light exit surface of the second light-condensing element is a grid surface.

7. A high and low beam integrated vehicle lamp lighting device comprising at least one first light source, at least one first light-condensing element, at least one second light source, at least one second light-condensing element, a light distribution element and a lens, wherein the first light-condensing element is arranged to be capable of condensing light emitted by the corresponding first light source and making the light projected through the lens by means of the light distribution element to form a low beam shape, and the second light-condensing element is arranged to be capable of condensing light emitted by the corresponding second light source and making the light projected through the lens by means of the light distribution element to form a high beam shape;

wherein the light exit direction of at least one of the first light-condensing element and the second light-condensing element intersects with a light shape projection direction;

wherein the light distribution element comprises a first light passing portion and a second light passing portion, the first light passing portion is connected to the second light passing portion through a total reflection surface to form an L-shaped structure, and the second light passing portion is provided with a cut-off portion for forming a low beam cut-off line;

the first light-condensing element is disposed on a light entrance surface of the first light passing portion and is integrally formed with the first light passing portion; and the second light-condensing element is located behind and below the light distribution element and is arranged to make the exit light thereof projected through the lens to form the high beam shape; or the second light-condensing element is disposed on the light entrance surface of the first light passing portion and is integrally formed with the first light passing portion; and the first light-condensing element is located behind and above the light distribution element and is arranged to make the exit light thereof intercepted by the cut-off portion and projected through the lens to form the low beam shape with the low beam cut-off line.

8. The high and low beam integrated vehicle lamp lighting device according to claim 7, wherein the light distribution element further comprises a III region forming portion, the III region forming portion is located on a first surface or a second surface of the second light passing portion, and the first surface and the second surface are disposed opposite to each other.

9. The high and low beam integrated vehicle lamp lighting device according to claim 8, wherein the III region forming portion is disposed on the first surface, and the III region forming portion is a groove.

10. The high and low beam integrated vehicle lamp lighting device according to claim 9, wherein a bottom surface of the groove is provided with a grid pattern or a strip pattern.

11. The high and low beam integrated vehicle lamp lighting device according to claim 8, wherein the III region forming portion is disposed on the first surface, the III region forming portion is a protrusion, and a surface of the protrusion opposite to the first surface is disposed at an included angle with the first surface.

12. The high and low beam integrated vehicle lamp lighting device according to claim 11, wherein the surface of the protrusion opposite to the first surface is provided with a grid pattern or a strip pattern.

13. The high and low beam integrated vehicle lamp lighting device according to claim 8, wherein the III region forming portion is disposed on the second surface, the III region forming portion is a protrusion, and a cross section of the protrusion is triangular.

14. The high and low beam integrated vehicle lamp lighting device according to claim 7, wherein a light exit surface of the second light passing portion is a concave curved surface.

15. A high and low beam integrated vehicle lamp lighting device comprising at least one first light source, at least one first light-condensing element, at least one second light source, at least one second light-condensing element, a light distribution element and a lens, wherein the first light-condensing element is arranged to be capable of condensing light emitted by the corresponding first light source and making the light projected through the lens by means of the light distribution element to form a low beam shape, and the second light-condensing element is arranged to be capable of condensing light emitted by the corresponding second light source and making the light projected through the lens by means of the light distribution element to form a high beam shape;

wherein the light exit direction of at least one of the first light-condensing element and the second light-condensing element intersects with a light shape projection direction;

wherein the light distribution element comprises an L-shaped low beam distribution element and an L-shaped high beam distribution element, the low beam distribution element corresponds to each of the first light-condensing elements, and the high beam distribution element corresponds to each of the second light-condensing elements;

wherein the low beam distribution element comprises a low beam up-down light channel a low beam total reflection surface and a low beam front-rear light channel, the low beam up-down light channel is connected to the low beam front-rear light channel through the low beam total reflection surface to form an L-shaped structure, and a light entrance surface of the low beam up-down light channel is integrally provided with the first light-condensing elements; and the high beam distribution element comprises a high beam up-down light channel, a high beam total reflection surface and a high beam front-rear light channel, the high beam up-down light channel is connected to the high beam front-rear light channel through the high beam total reflection surface to form an L-shaped structure, and a light entrance surface of the high beam up-down light channel is integrally provided with the second light-condensing elements.

16. The high and low beam integrated vehicle lamp lighting device according to claim 15, wherein a lower side line of a light exit surface of the low beam distribution element is in contact with an upper side line of a light exit surface of the high beam distribution element, and a wedge-shaped gap gradually increasing from front to rear is formed between the low beam distribution element and the high beam distribution element.

17. The high and low beam integrated vehicle lamp lighting device according to claim 15, wherein one or more of the low beam total reflection surface or a lower side surface of the low beam front-rear light channel is provided with a high-reflecting film, the light exit surface of the low beam distribution element is provided with an anti-reflection film, one or more of the high beam total reflection surface or an upper side surface of the high beam front-rear light channel is provided with a high-reflecting film, and the light exit surface of the high beam distribution element is provided with an anti-reflection film.

18. A vehicle lamp, comprising the high and low beam integrated vehicle lamp lighting device according to claim 1.

* * * * *